US007441989B2

(12) United States Patent
Fleming

(10) Patent No.: US 7,441,989 B2
(45) Date of Patent: Oct. 28, 2008

(54) BEAVER CONTROL DEVICE FOR A CULVERT PIPE

(76) Inventor: Walter Fleming, #40 Highway 11, Jellicoe, Ontario (CA) P0T 1V0

( * ) Notice: Subject to any disclaimer, the term of this patent is extended or adjusted under 35 U.S.C. 154(b) by 132 days.

(21) Appl. No.: 11/222,219

(22) Filed: Sep. 9, 2005

(65) Prior Publication Data

US 2007/0059101 A1 Mar. 15, 2007

(51) Int. Cl.
*E03F 7/06* (2006.01)

(52) U.S. Cl. ..... 405/125; 43/58

(58) Field of Classification Search ..... 405/124–126; 43/58, 60, 61, 64–66, 80, 77, 100, 101
See application file for complete search history.

(56) References Cited

U.S. PATENT DOCUMENTS 1,371,143 A * 3/1921 Bradburn ..... 210/460
4,998,847 A * 3/1991 Thurber ..... 405/127
5,102,537 A * 4/1992 Jones ..... 210/162
6,447,206 B1 * 9/2002 Fleury ..... 405/125

* cited by examiner

*Primary Examiner*—Sunil Singh
(74) *Attorney, Agent, or Firm*—Ade & Company Inc.; Kyle R. Satterthwaite; Adrian D. Battison

(57) ABSTRACT

A beaver control device for a culvert pipe features a generally conical screen having a base portion and an apex portion connected by a plurality of rods. The base portion has a rim sized to fit about the end of the culvert pipe. The apex portion has a rim with an opening sized to selectively receive a weeping tile or other drainage pipe. The screen prevents beavers from damming the culvert while allowing the drainage pipe to drain into or pass through the culvert. A pin is provided to either lock the drainage pipe in place or partially close off the opening in the apex portion when not in use. The screen is movable between raised and lowered positions to allow easy access to the screen and culvert. In one embodiment, the screen is constructed in multiple pieces to allow for easy transport and on-site assembly.

13 Claims, 6 Drawing Sheets

20
46
44
50
48
1
30
42
32
36
34
38
40
10

BEAVER CONTROL DEVICE FOR A CULVERT PIPE

This invention relates generally to a cone-shaped screen for attachment to an end of a culvert pipe for preventing beavers from building a dam to block the flow of water. More particularly, the present invention relates to a cone-shaped screen having an apex portion for selective connection to a drainage pipe arranged to drain into or pass through the culvert pipe.

BACKGROUND OF THE INVENTION

Culvert pipes are widely used to allow water to flow beneath roads without having to redirect it or construct a bridge to pass over the stream. Unfortunately, such pipes represent an ideal place for beavers to construct a damn and restrict the flow of water. These damns can quickly cause flooding and washouts when water levels are elevated, for example, by heavy rains or melting snow. Vertical screens or grates have been used to prevent beavers from entering culverts, but such devices do not discourage beavers from building dams at the ends of a culvert pipe. Also, water flows tend to deposit debris at such barriers which builds up over time and restricts flow through the culvert.

U.S. Pat. Nos. 5,102,537 and 6,447,206 disclose cone-shaped screens that were intended to overcome the limitations of the flat designs discussed above. A base end of the screen attached to the end of the culvert has a series of rods extending outward from the culvert to an apex end. The rods are spaced by a distance that allows small debris to pass through without clogging the culvert while preventing entry by beavers and similarly sized animals. The beavers cannot construct an ideal damn at the opening of the culvert as they cannot properly anchor the structure.

As a result of limiting access to the culvert by beavers, the prior art also limits access to the culvert pipe by others. For example, it may be useful to connect other drainage systems, such as weeping tile, to existing culvert pipes. The combination of such systems is often ideal as it eliminates the need for separate piping systems and thus reduces cost and environmental interference. In addition, large culverts require correspondingly large screens that are difficult and costly to transport due to their dimensions. As a result, there is a desire for a beaver control device that is easy to transport and prevents dam construction and debris buildup at the end of a culvert pipe while allowing the connection of other drainage sources to the culvert.

SUMMARY OF THE INVENTION

According to a first aspect of the invention there is provided a combination of a beaver control device, a culvert pipe and a drainage pipe, said combination comprising:

a generally conical screen having opposite first and second ends, said generally conical screen comprising:

- a base portion at the first end of the generally conical screen, said base portion comprising a rim having an opening therein for receiving an end of the culvert pipe;
- an apex portion at the second end of the generally conical screen, said apex portion comprising a rim having an opening therein for selectively receiving the drainage pipe;
- a plurality of spaced apart rods extending from the first end to the second end and connecting the base and apex portions; and
- a retaining member for maintaining selective coupling between the apex portion and the drainage pipe.

The present invention overcomes the shortcomings of the prior art by providing an apex portion that is arranged to selectively couple with a drainage pipe such as those found in a weeping tile drainage system. A retaining member is provided to ensure that the drainage pipe is held in place when connected to the beaver control device so that animals cannot dislodge the drainage pipe from the desired position in which it drains into the culvert pipe. The rods extending between the base and apex portions prevent beavers from approaching the end of the culvert pipe while allowing small debris to flow through the openings between them.

Preferably the retaining member is supported on the apex portion and comprises a pin movable between an open position and a closed position. Preferably, the pin extends across the opening of the apex portion in the closed position, thereby blocking a portion of said opening, and does not extend across said opening in the open position, thereby leaving said opening substantially unobstructed. Preferably, the pin is arranged to pass through at least one hole in the drainage pipe during movement from the open position to the closed position if said drainage pipe has been received in said opening, thereby securing said drainage pipe to the apex portion. So when a drainage pipe is not connected to the apex end of the device, the pin is placed in the closed position to block off the opening to prevent beavers from entering the screen. When a drainage pipe is connected, the pin is used to lock the pipe in place so that the beavers cannot knock it free from the screen.

Preferably the base portion comprises mounting elements for connecting the generally conical screen to the end of the culvert pipe for motion between a lowered position in which said screen substantially blocks the end of the culvert pipe and a raised position in which said screen does not substantially block at least a portion of said end of said culvert pipe. The raised position allows for easier cleaning of the device to remove any build up of debris.

Preferably each mounting element comprises a length of chain attached at opposite ends thereof to the base portion of the generally conical screen and the end of the culvert pipe.

Preferably there is provided a coupler supported on the apex portion.

There may be provided an actuator for moving the generally conical screen between the lowered and raised positions. In this case, preferably the actuator comprises a flexible longitudinal member attached to the apex portion and extending toward the base portion such that pulling said longitudinal member away from the apex portion causes the generally conical screen to pivot about the end of the culvert pipe from the lowered position to the raised position. The use of such a flexible longitudinal member, like a rope or chain, allows the device to be easily raised and lowered for occasional cleaning.

The base and apex portions may comprise a plurality of base members and apex members respectively, each base member being connected to a respective apex member by respective ones of the plurality of rods. In this case, preferably adjacent base members are coupled together and adjacent apex members are coupled together. Preferably the adjacent members are detachably coupled by bolts at flanges provided at opposite ends of each member. This allows the device to be partially assembled on-site from multiple pieces which can be transported with less hassle and lower costs.

According to a second aspect of the invention there is provided a combination of a beaver control device and a culvert pipe, said combination comprising:

a generally conical screen having opposite first and second ends, said generally conical screen comprising:

a base portion for connection to an end of the culvert pipe at the first end of the generally conical screen;

an apex portion at the second end of the generally conical screen; and a plurality of spaced apart rods extending from the first end to the second end and connecting the base and apex portions;

the base and apex portions comprising a plurality of base members and apex members respectively, each base member being connected to a respective apex member by respective ones of the plurality of rods;

adjacent base members being coupled together such that the base members collectively define a base rim having an opening therein for receiving an end of the culvert pipe; and adjacent apex members being coupled together.

BRIEF DESCRIPTION OF THE DRAWINGS

In the accompanying drawings, which illustrate exemplary embodiments of the present invention.

DETAILED DESCRIPTION OF THE PROCESS

Figure 1:
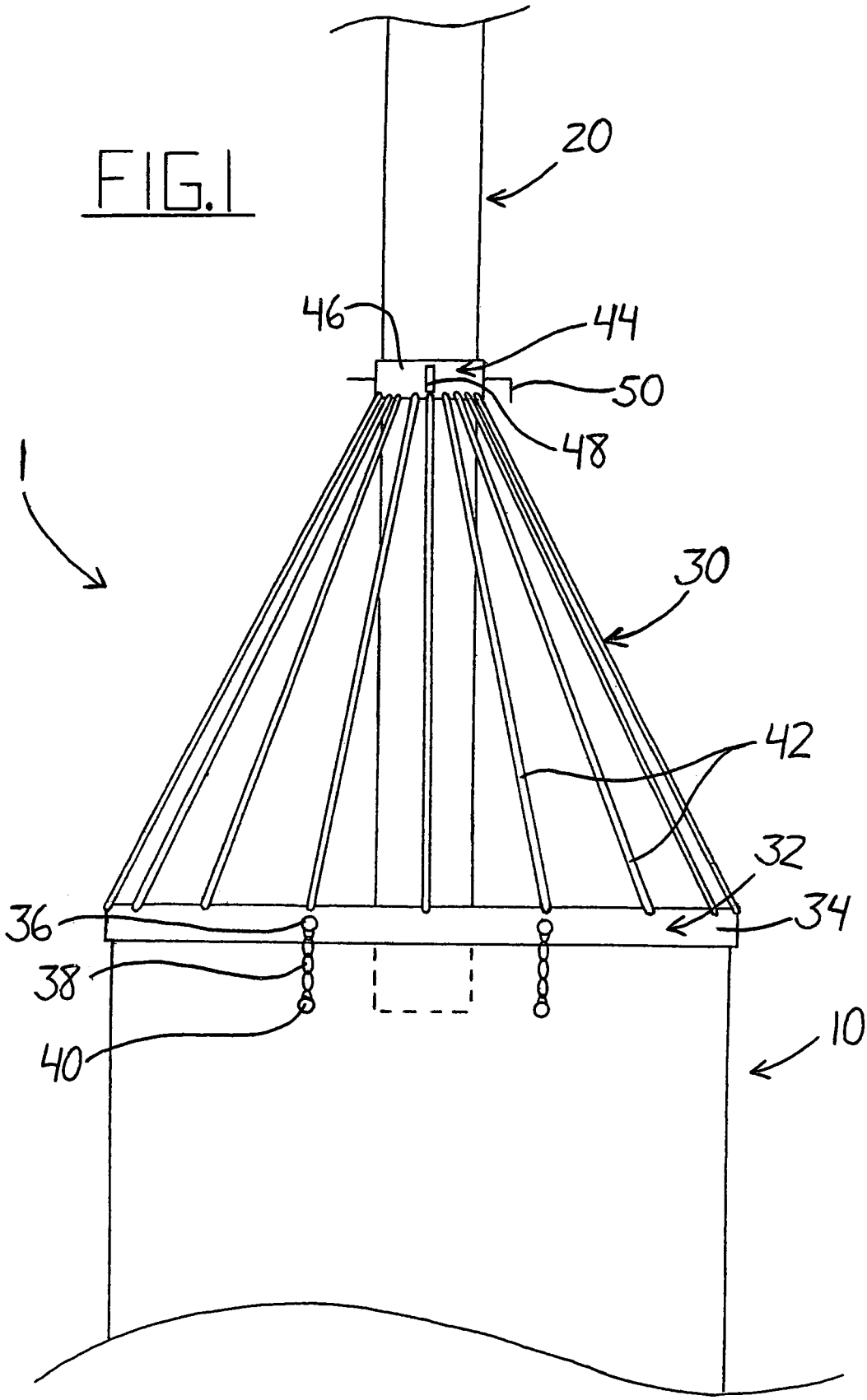
FIG. 1 is a top plan view of a beaver control device according to a first embodiment of the present invention installed between a culvert pipe and a weeping tile pipe.
Figure 2:
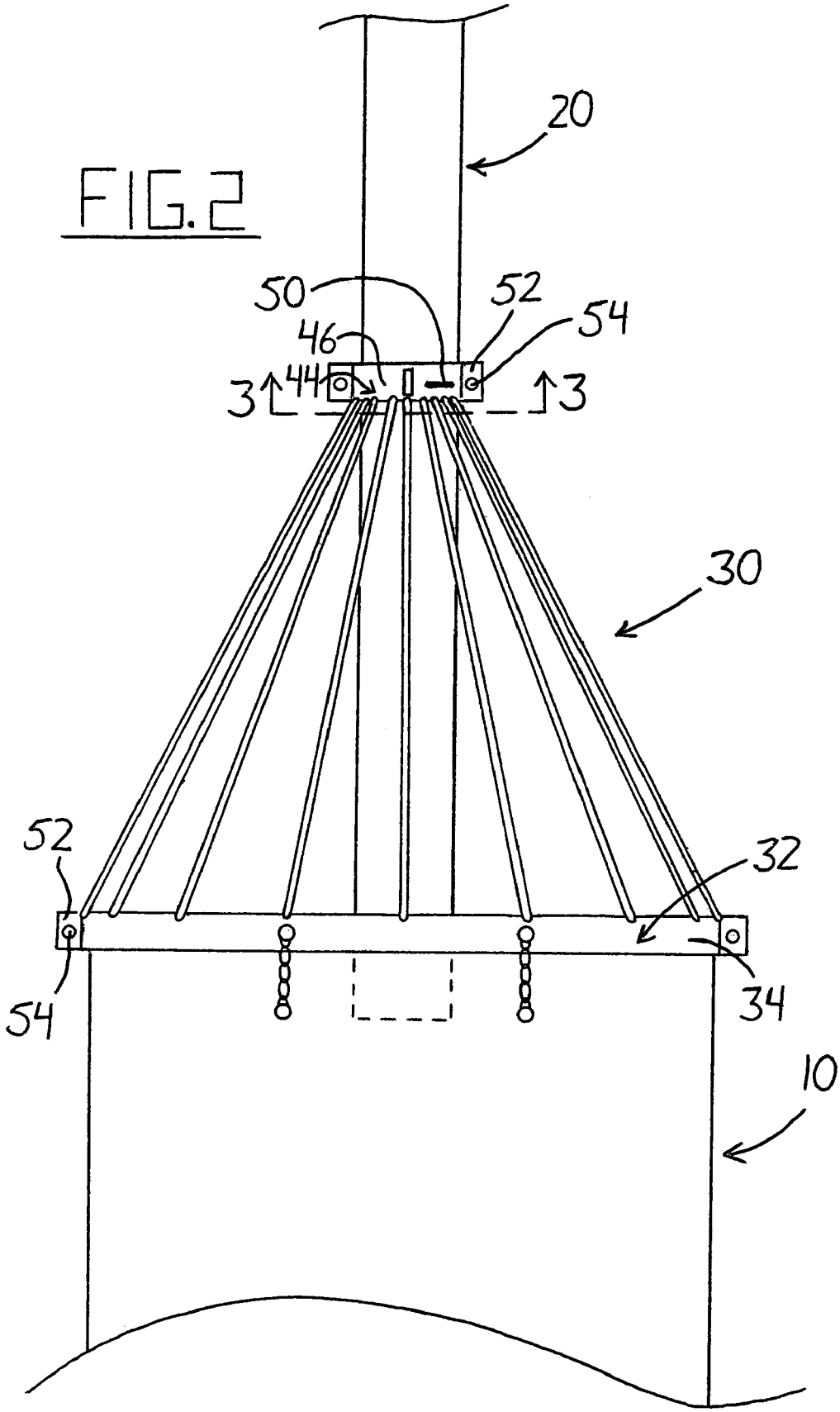
FIG. 2 is a top plan view of a beaver control device according to a second embodiment of the present invention installed between the culvert and the weeping tile pipe.

FIGS. 1 and 2 show overhead views of different embodiments of a beaver control device 1 called the "Beavercone" as installed in cooperation with a weeping tile pipe 20 and a culvert pipe 10. As can be seen, the weeping tile pipe 20 is arranged to drain into the culvert pipe 10 and so the beaver control device 1 must accommodate this arrangement. The device 1 is a generally conical screen 30 made up of a base portion 34 connected to the culvert pipe 10, an apex portion 44 connected to the weeping tile pipe 20 and a plurality of rods 42 extending between the two portions at the opposite ends. The rods are arranged to prevent beavers from entering the screen 30 and building a dam at the entrance to the culvert 10. The conical shape also prevents the build up of debris at the entrance of the culvert 10 associated with the installation of flat screens or grills. The present invention can be used on a culvert pipe 10 regardless of whether weeping tile 20 is in place or not.

FIG. 1 illustrates a first embodiment of the device 1 which is constructed to form a single structure that is installed without further assembly. The base portion 32 has a circular rim 34 which is dimensioned to fit over the end of the culvert pipe 10 such that the opening of the pipe 10 is not blocked in any way by the base portion 32. The base portion 32 is further connected to the culvert pipe 10 by means of two lengths of chain 38 spaced apart near the top of the device 1 and culvert 10. The chains 38 are attached to the base portion 32 by bolts 36 secured through the rim 32. Similarly, the chains 38 are attached to the culvert pipe 10 by means of bolts 40. The chains 38 ensure that the screen 30 remains secured to the culvert 10, but do allow limited motion of the device 1 with respect to the culvert, the purpose of which will be explained below. Similar to the base portion 32, the apex portion 44 has a circular rim 46 which is dimensioned to fit over the end of the weeping tile pipe 20 such that the pipe 20 is received within an opening 56 defined by the rim 46.

Supported on the rim 46 of the apex portion 44 is a coupler in the form of a vertically extending hook 48, the purpose of which will be explained in conjunction with the limited motion allowed by the chains 38 below. The screen 30 also includes a retaining member in the form of a pin 50 which passes through aligned holes 51 in the apex rim 46. The purpose of the pin 50 is twofold. Firstly, the pin 50 serves to lock the weeping tile pipe 20 in place as shown in FIG. 1. Aligned holes 21 are provided in the weeping tile pipe 20 corresponding to the aligned holes 51 in the apex rim 46 such that the pin 50 can be passed through both objects. So not only is the weeping tile 20 received and positioned by the rim 46, but it is further retained by engagement with the pin 50. This would prove useful in an arrangement where the weeping tile 20 passes through the opening defined by the apex rim 46 but does not extend all the way to the culvert 10 as shown in the figure. In such a case, small relative movement of the weeping tile 20 and screen 30 could result in separation of the two, but such movement is prevented by the pin 50. Secondly, the pin 50 serves to partially block off the opening 56 defined by the rim 46 which is important for the case where weeping tile is not coupled to the screen 30. Without weeping tile 20 received in the opening 56 of the apex portion 44, beavers could enter the screen 30 to gain access to the culvert pipe 10 by means of the opening. By dividing the opening 56 into two smaller openings, the pin 50 closes off this access route. As a result, the invention can be used to successfully prevent the construction of beaver dams at culvert entrances or exits regardless of the presence or lack of weeping tile or similar drainage piping.

Figure 3:
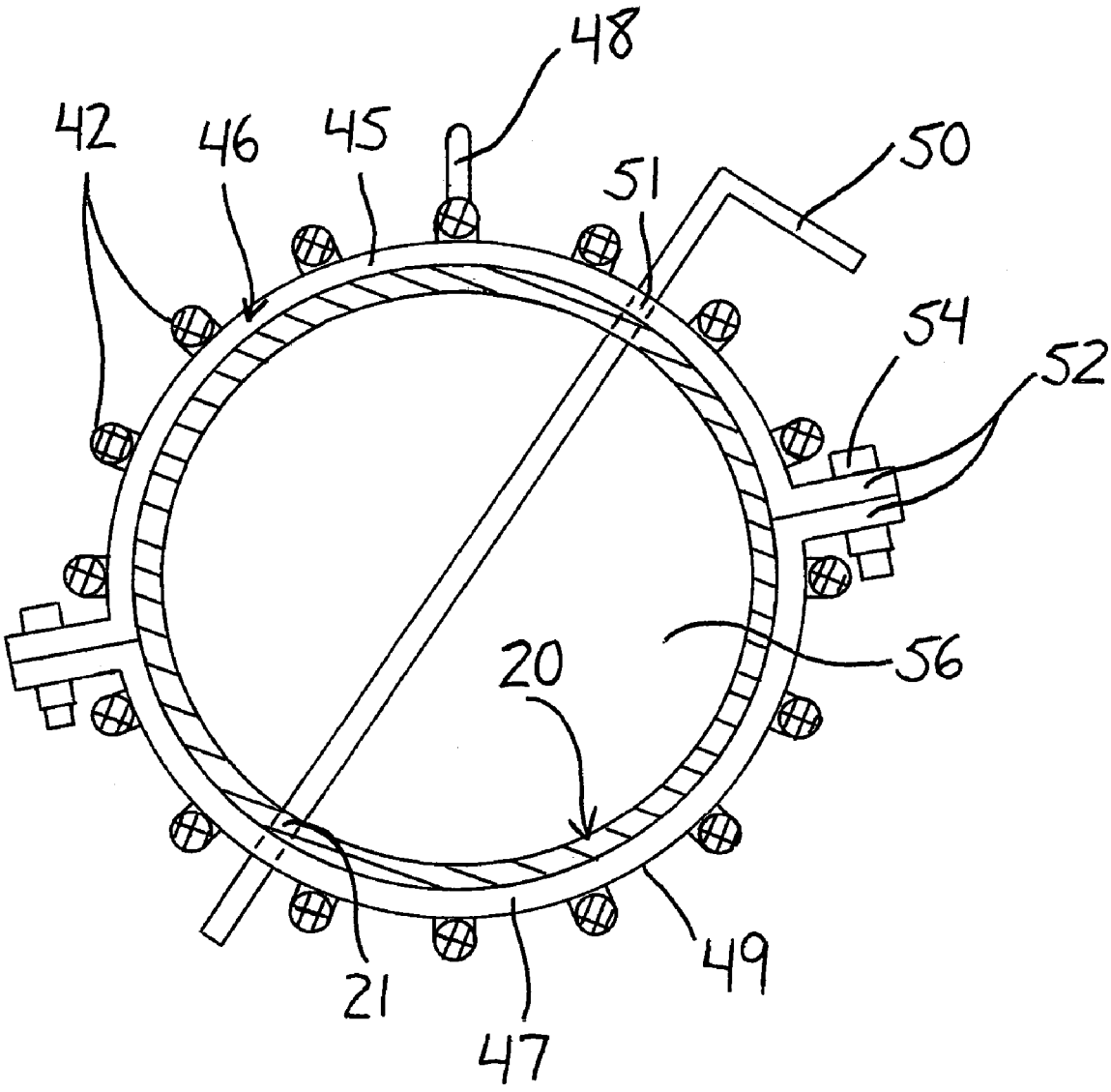
FIG. 3 is a cross sectional view of the beaver control device and weeping tile pipe of FIG. 2 as taken from line 3-3.
Figure 6:
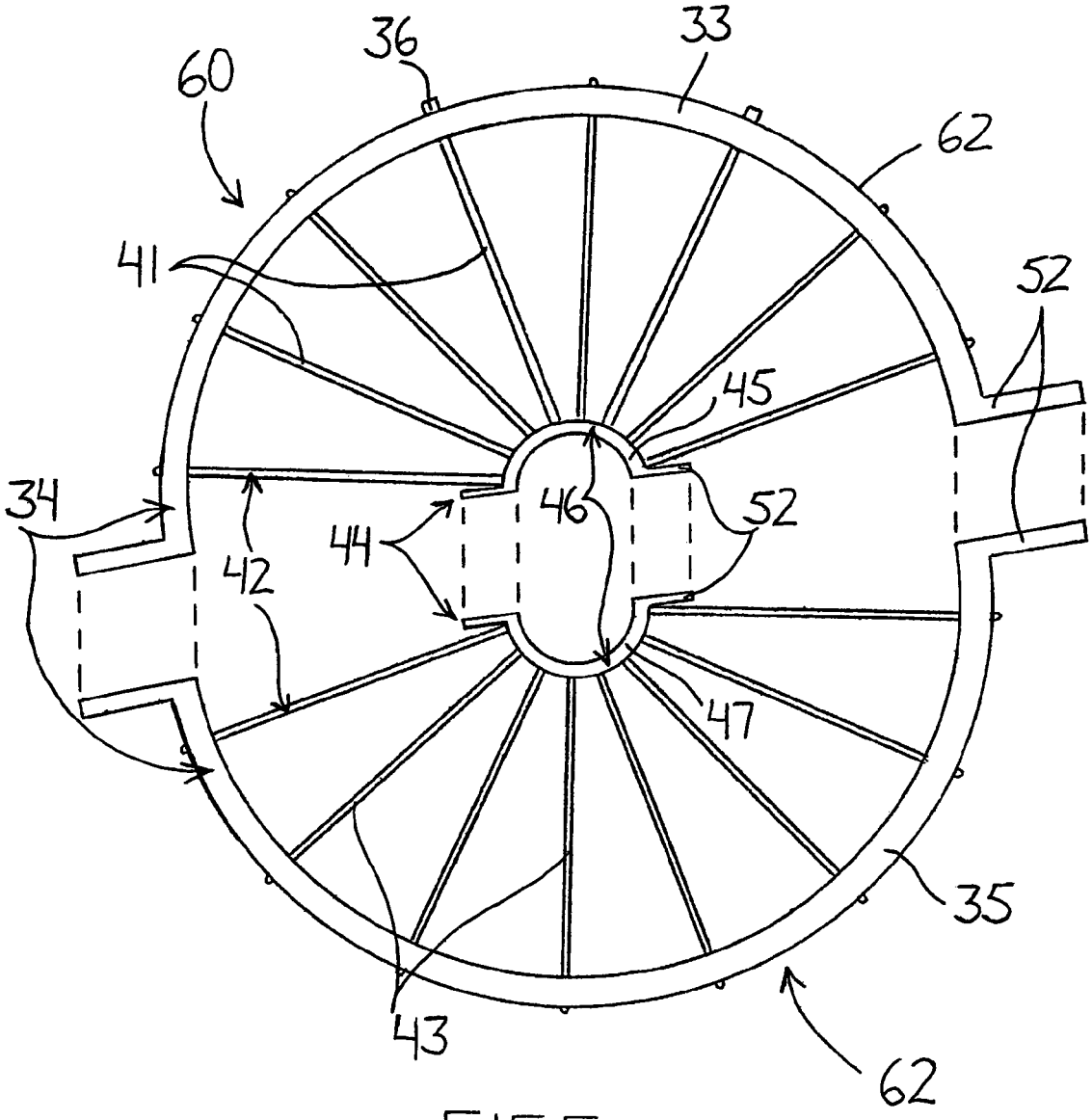
FIG. 6 is an end view of the beaver control device of FIG. 2 before assembly of its two halves.

FIG. 2 illustrates a second embodiment of the beaver control device 1 in which the screen 30 is made of two pieces which can be assembled on-site. This proves useful for larger applications requiring screens of significant dimensions that may be difficult and/or costly to transport. While having the same general structure as the embodiment of FIG. 1, the difference lies in the rims 34 and 46 of the base portion 32 and apex portion 44 respectively. Here the rims are each made of two semi-circular portions that are detachably coupled together by bolts 54 at flanges 52. FIG. 3 shows a cross section taken along line 3-3 of FIG. 2 near the apex portion 44 which illustrates the two piece construction more clearly. The apex rim 46 is made up of two semicircular apex members 45 and 47. A flange 52 is provided at each end of each member so that when the flanges 52 of members 45 and 47 are aligned, they fit together in a flush manner. The flanges 52 are connected by a bolt 54 and the apex members 45 and 47 collectively form the circular rim 46 having a circular opening 56. The construction of the rim 34 of the base portion 32 is the same, except on a larger scale. As shown in FIG. 6, the base rim 34 is made up of two semicircular base members 33 and 35, corresponding to apex members 45 and 47 respectively. The top apex and base members 45 and 33 are connected by respective upper rods 41 and the bottom apex and base members 47 and 35 are connected by respective lower rods 43. The result is that the conical screen 30 is made up of two halves 60 and 62 which are coupled together at the base and apex portions 32 and 44 by means of flanges 52 and bolts 54. So the two halves 60 and 62 of the screen 30 can be transported separately or nested one within the other during transport in which space is limited. These two haves 60 and 62 can then be assembled on-site during installation on the culvert pipe 10. If it becomes desirable to move the screen 30 to another location, the bolts 54 can be removed to disassemble the screen 30 for transport to the new location.

FIG. 3 further illustrates the weeping tile 20 as being received in the opening 56 of the rim 46 of the apex portion 44. Diametrically opposite holes 51 (in other words, holes aligned through the center of the rim 46) are provided such that the pin 50 can be passed through the rim 46. A similar pair of diametrically opposite holes 21 are made in the weeping tile pipe 20 so that should it be desirable to receive the weeping tile 20 in the opening 56, the radially and longitudinally aligned holes allow the pin 50 to be passed through both the rim 46 and the weeping tile pipe 20 in order to lock them in a coupled relationship. As shown in the figure, the rods 42 of the screen 30 are welded to the radially outermost surface 49 of the rim 46, opposite the opening 56. Mounting the rods 42 on this outside surface 49 ensures that they do not interfere with the insertion of the weeping tile pipe 20 into the opening 56 of the rim 46. Similarly, the rods 42 are welded to the radially outermost surface 62 of the of the rim 34 of the base portion 32 to ensure that they do not interfere with the installation of the base rim 34 about the end of the culvert.

Figure 4:
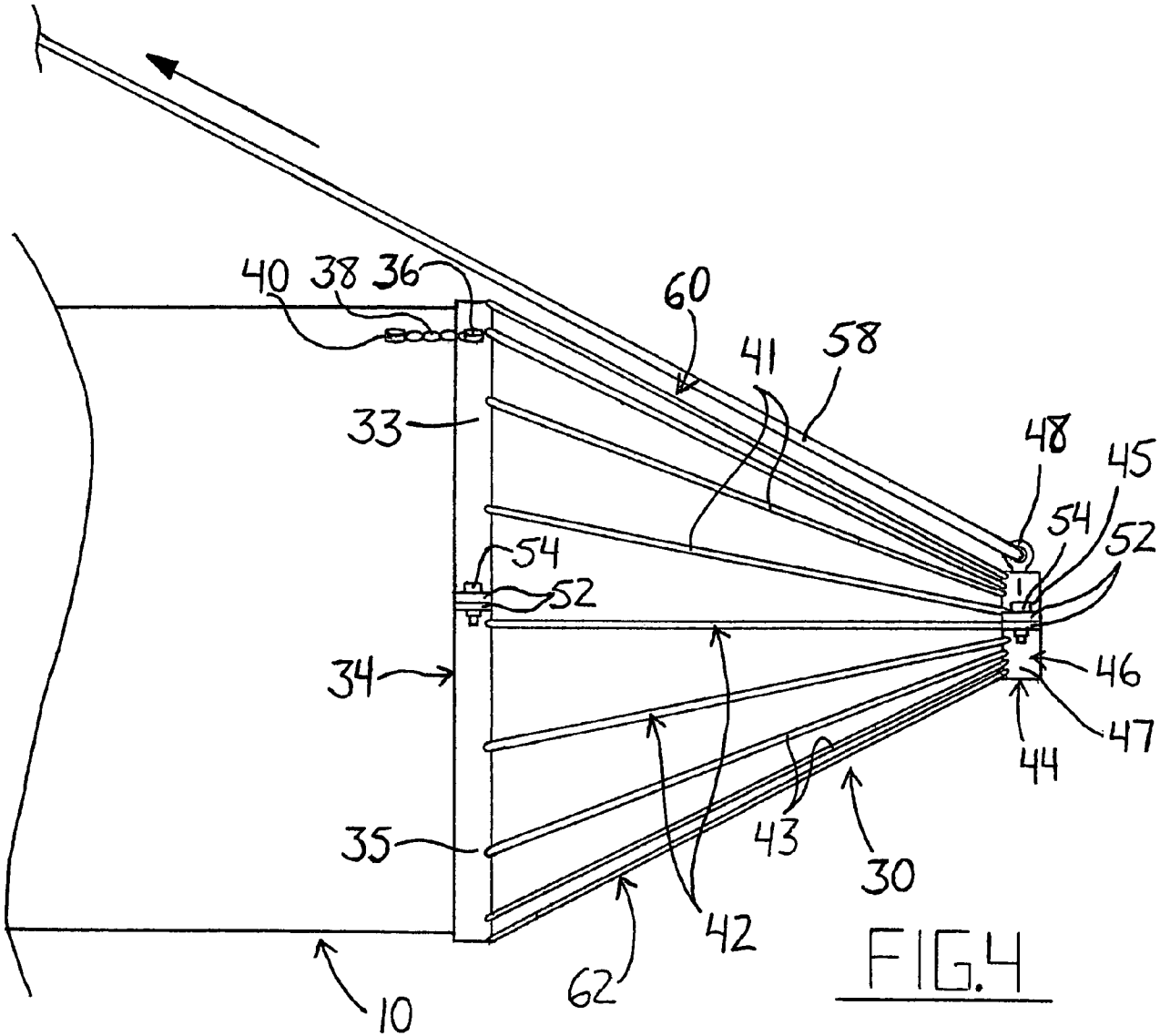
FIG. 4 is a side view of the beaver control device of FIG. 2 in a closed position on the culvert pipe with a rope used for moving the beaver control device relative to the culvert pipe.
Figure 5:
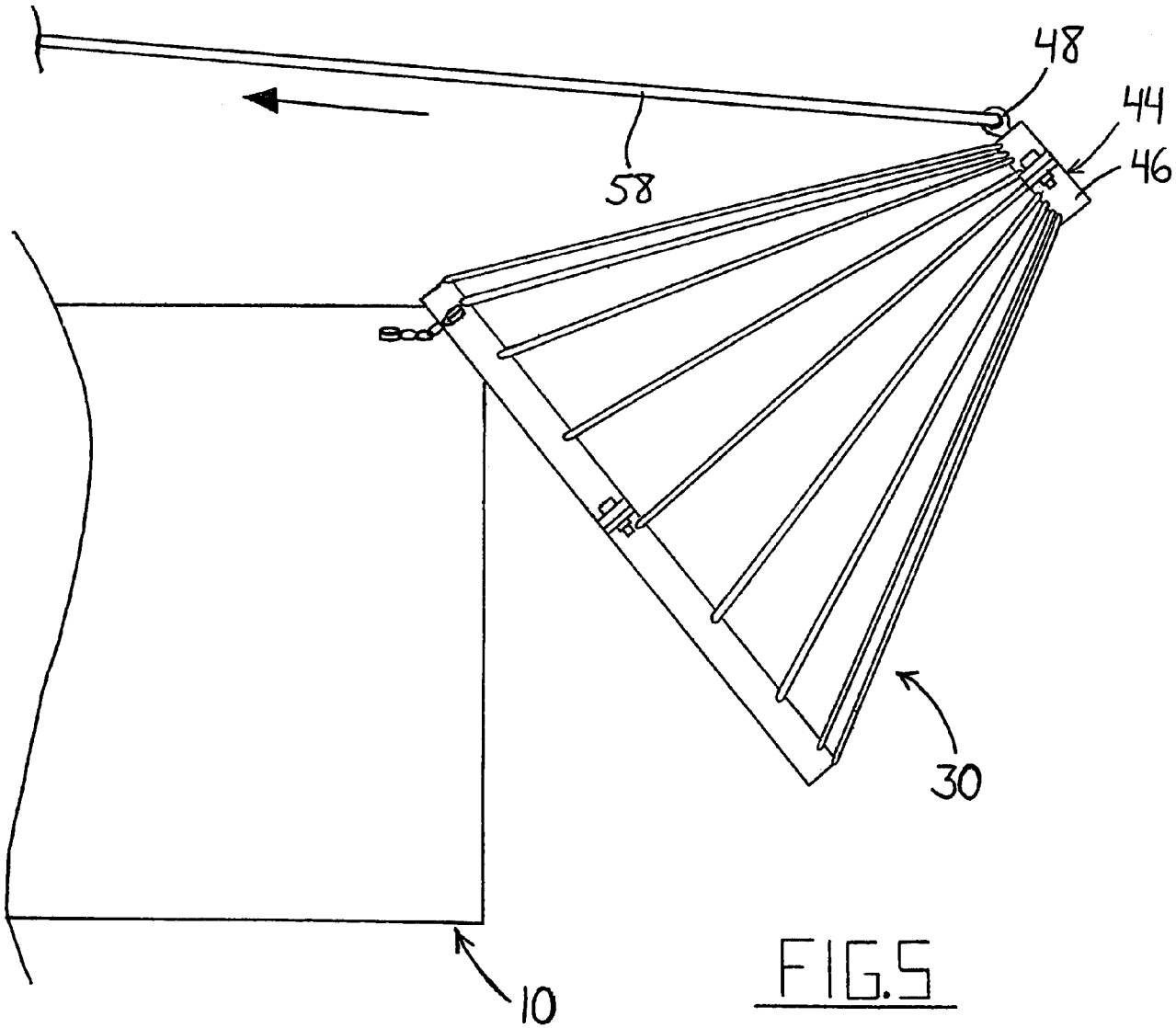
FIG. 5 is a side view of the beaver control device of FIG. 3 with the rope having been sufficiently pulled to move the beaver control device into an open position on the culvert.

FIG. 4 is a side view of the screen 30 installed on a culvert pipe 10 without weeping tile 20. Should debris build up somewhere on or near the screen 30, it may prove difficult to clear in the lowered position shown, as a significant portion of the screen 30 may be submerged in water. As a result, it is desirable to mount the screen 30 on the culvert 10 in such a way that it is movable between the lowered position of FIG. 4 and the raised position of FIG. 5. The hook 48 provided on the rim 46 of the apex portion 44 and the chains 38 connecting the base portion 32 and the culvert 10 work together to provide this motion. A rope 58 tied to the hook 48 is pulled in the direction indicated by the arrow in order to pivot the screen 30 upward about the end of the culvert 10, raising the apex portion 44. In this position, the screen 30 and culvert 10 will be easier to clean. It should be appreciated that because the screen 30 is not mounted on a transverse shaft, but rather attached to the culvert 10 by means of the chains 38, the motion will not be purely pivotal as the chains do allow limited translational motion as well. The result is the transition of the screen 30 between the lowered position generally aligned with the length of the culvert pipe 10 and the raise position inclined with respect to the pipe 10. When weeping tile 20 is coupled with the screen 30, the tile and screen should be separated before raising the screen.

In the one piece construction of the first embodiment, the rims 34 and 46 of the base portion 32 and apex portion 44 are flat bars of generally circular shape. In the two piece construction, flat bars are again used for the base and apex members but are semicircular in shape. The flanges 52 are created by welding angle iron across the bars to create a radially outward extending piece along the width of the rim. It should be appreciated that these components can be made using alternate materials and processes known to those of skill in the art to obtain the same effect.

Similarly, means of mounting the screen 30 on the culvert 10 for the relative motion between the lowered and raised positions described above other than the combination of chains 38 and bolts 36 and 40 are known to those of skill in the art. For example, the chains 38 could be wrapped around the rim 34 and reattached to themselves instead of being bolted, or a hinge mechanism could be provided in place of the chains 38. Also, the rope 58 used as an actuator for movement of the screen 30 can be replaced by any number of suitable actuators known to those of skill in the art. Another example of a manually operated, flexible longitudinal member would be a chain. Another alternative is to mechanize the lifting process with a lifting apparatus, for example, using cylinders.

While the above embodiments have been described for use on a culvert pipe 10 in order to allow the possibility of running weeping tile pipe 20 through the screen 30 for draining into the culvert 10, it should be appreciated that pipes other than those used in weeping tile systems can be received in the opening 56 of the rim 46 of the apex portion 44. The device 1 can be easily modified to accept various tubes, pipes or conduits that drain into or pass through a culvert 10 having a screen 30. Furthermore, the shape of the screen 30 does not have to be a perfect conical portion and can be somewhat varied while still retaining the desired effect of narrowing from a larger end at the base to a smaller end at the apex. In cases where the culvert 10 is damaged and cannot properly support the device 1, a screen 30 with a base rim 34 having a diameter less than that of the culvert 10 may be installed by mounting the base portion 32 within the end of the culvert 10. Finally, while the second embodiment has the screen 30 divided into two separate halves 60 and 62 that are held together by bolts 54, it is also possible to further divide the screen 30 into additional pieces, such as quarters, to facilitate transport of very large beaver control devices. In addition, the pieces can be attached by means other than bolts, including more permanent fastening methods. While detachably coupling the pieces with bolts allows for easy removal, disassembly and transport at a later date, welding or other methods known to those of skill in the art can be used to permanently attached the pieces of the screen should it be desirable to do so.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A combination of a beaver control device, a culvert pipe and a drainage pipe, said combination comprising:

a generally conical screen having opposite first and second ends, said generally conical screen comprising:

a base portion at the first end of the generally conical screen, said base portion comprising a first rim sized to receive the end of the culvert pipe in a first opening defined by the first rim;

an apex portion at the second end of the generally conical screen, said apex portion comprising a second rim sized to selectively receive the drainage pipe in a second opening defined by the second rim;

a plurality of spaced apart rods extending from the first end to the second end and connecting the base and apex portions at spaced apart positions about the first and second rims; and a retaining mechanism cooperative with the generally conical screen and operable to effect selective coupling thereof to the drainage pipe to retain the drainage pipe in position to drain into the culvert.

2. The combination according to claim 1 wherein the retaining mechanism and the apex portion of the generally conical screen are arranged to effect selective coupling of the drainage pipe and the generally conical screen at the apex portion thereof.

3. The combination according to claim 1 wherein the retaining mechanism comprises a pin passable through aligned holes in the conical screen and the drainage pipe to effect coupling thereof.

4. The combination according to claim 3 wherein the aligned holes comprise holes in the second rim at spaced positions thereabout to facilitate passage of the pin through corresponding holes in the drainage pipe with the drainage pipe received in the second opening.

5. The combination according to claim 1 wherein the retaining mechanism is operable to move into a closed position obstructing the second opening without the drainage pipe received therein.

6. The combination according to claim 5 wherein the retaining mechanism comprises a pin passable through holes provided in the generally conical screen at spaced positions thereabout at the apex portion to selectively obstruct the second opening without the drainage pipe received therein, or secure the drainage pipe to the generally conical screen by passing through the pin corresponding holes in the drainage pipe with the drainage pipe received in the second opening.

7. The combination according to claim 6 wherein the holes are provided in the second rim.

8. The combination according to claim 1 wherein the base portion comprises mounting elements arranged to connect the generally conical screen to the end of the culvert pipe for motion between a closed position in which said screen substantially blocks the end of the culvert pipe and an open position in which said screen does not substantially block at least a portion of said end of said culvert pipe.

9. The combination according to claim 8 wherein each mounting element comprises a length of chain attached at opposite ends thereof to the base portion of the generally conical screen and the end of the culvert pipe to facilitate pivotal-like motion of the generally conical screen about the end of the culvert pipe.

10. The combination according to claims 8 wherein the conical screen further comprises a coupler supported on the apex portion to facilitate connection of an actuator thereto to effect movement of the generally conical screen between the closed and open positions.

11. The combination according to claim 8 further comprising an actuator connected to the generally conical screen to effect movement thereof between the closed and open positions.

12. The combination according to claim 11 wherein the actuator comprises a longitudinal member attached to the apex portion and extending toward the base portion such that pulling said longitudinal member away from the apex portion causes the generally conical screen to pivot about the end of the culvert pipe from the closed position to the open position.

13. The combination according to claim 8 wherein the the mounting elements and the generally conical screen are arranged for generally pivotal motion of the generally conical screen to lift the apex portion upward and toward the end of the culvert pipe.

* * * * *